US009198548B2

(12) United States Patent
De Vito, Jr.

(10) Patent No.: US 9,198,548 B2
(45) Date of Patent: Dec. 1, 2015

(54) CLOSING MECHANISM FOR TOILET

(76) Inventor: George A De Vito, Jr., Greer, SC (US)

( * ) Notice: Subject to any disclaimer, the term of this patent is extended or adjusted under 35 U.S.C. 154(b) by 692 days.

(21) Appl. No.: 13/483,668

(22) Filed: May 30, 2012

(65) Prior Publication Data

US 2013/0318695 A1 Dec. 5, 2013

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1, 253
See application file for complete search history.

(56) References Cited

U.S. PATENT DOCUMENTS 1,254,255 A * 1/1918 Mavrakis ..... 4/246.3
3,781,924 A 1/1974 Davis, Jr.
5,153,946 A * 10/1992 Yoke et al. ..... 4/248
5,592,700 A 1/1997 Genesse
6,151,723 A * 11/2000 MacAllister ..... 4/246.1
6,226,804 B1 * 5/2001 Ballard ..... 4/246.1
7,150,049 B1 * 12/2006 Fitch ..... 4/246.1
8,671,469 B1 * 3/2014 LaMura ..... 4/246.1
8,966,888 B2 * 3/2015 Weaver et al. ..... 60/409
2002/0198072 A1 12/2002 LaSee
2006/0242755 A1 * 11/2006 Lohss ..... 4/246.1
2010/0313343 A1 * 12/2010 Kang et al. ..... 4/246.1

OTHER PUBLICATIONS

Skymall, Inc.; Touchless Sensor Toilet Seats; Web site print outs from http://www.skymall.com/shopping/search.htm; visited May 4, 2012; 3 pages from website; publisher is Skymall, Inc.: pp. 1-3; city is Pheonix, Arizona, USA; copyright 2012; copyright Skymall, Inc.; (3 pages).

* cited by examiner

*Primary Examiner* — Janie Christiansen
(74) *Attorney, Agent, or Firm* — Metz Lewis Brodman Must O'Keefe LLC

(57) ABSTRACT

A closing mechanism for a toilet is provided that includes a frame attached to the toilet, and a closing member carried by the frame and attached to a pivoting member of the toilet. A sensor may be carried by the frame and is capable of sensing when a user of the toilet leaves a field of view of the sensor. The sensor sends a signal when the user of the toilet leaves the field of view of the sensor that causes the closing member to rotate the pivoting member from an open position to a closed position.

17 Claims, 8 Drawing Sheets

CLOSING MECHANISM FOR TOILET

FIELD OF THE INVENTION

The present invention relates generally to a closing mechanism for a toilet that can move one or more pivoting members from an open position to a closed position. More particularly, the present application involves a closing mechanism for a toilet that has a sensor that can determine when a user leaves the vicinity of the toilet and that automatically causes a lid and/or seat of the toilet to move from an open position down to a closed position.

BACKGROUND

Toilets are generally provided with a movable seat that can be rotated from a closed, down position to an open, up position and back as desired. Most toilets are also provided with a movable lid that can likewise be moved from a closed, down position to an open, up position and back as desired. The lid may be capable of being rotated independently of the seat such that the seat may be down and the lid may be up. Men and women use a toilet differently due to their anatomical differences and it may be the case that the seat is left in an inconvenient position for a subsequent user of the toilet in the household. Further, the lid may be inadvertently left in the open position after use of the toilet. This orientation may allow household pets to undesirably drink out of the toilet or may allow for contamination to escape the toilet when flushed or simply when the lid remains open for an extended amount of time. As such, it is desirable to immediately properly orient the seat and/or lid of a toilet to a closed position when the user gets done with the toilet and leaves the vicinity of the toilet.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
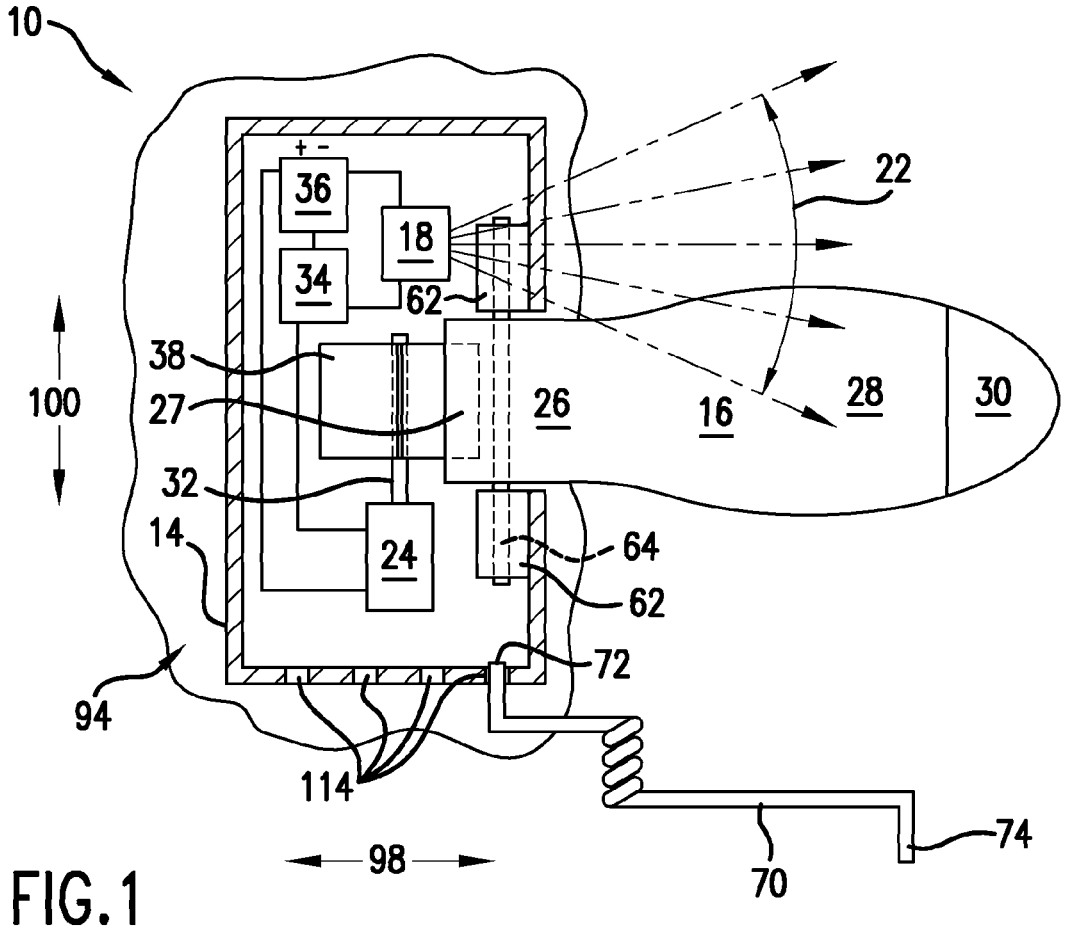
FIG. 1 is a top, partial cross-sectional view of a closing mechanism in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a closing mechanism 10 that can be used to close a pivoting member 40 of a toilet 12 that was inadvertently left in an open position 44. The closing mechanism 10 includes a closing member 16 that can engage the pivoting member 40 and cause it to rotate from the open position 44 down to a closed position 46 once the closing mechanism 10 determines that a user 20 of the toilet 12 has left the vicinity of the toilet 12. The closing mechanism 10 includes a sensor 18 that can sense when the user 20 leaves a field of view 22 of the sensor 18. When this happens, the closing mechanism 10 may determine that the user 20 has left the toilet 12 and if the pivoting member 40 is in the open position 44 the closing mechanism 10 may effect closure. The closing mechanism 10 can be arranged so that pivoting members 40 such as lids and seats of the toilet 12 are both closed if one or both of them are inadvertently left open.

Figure 2:
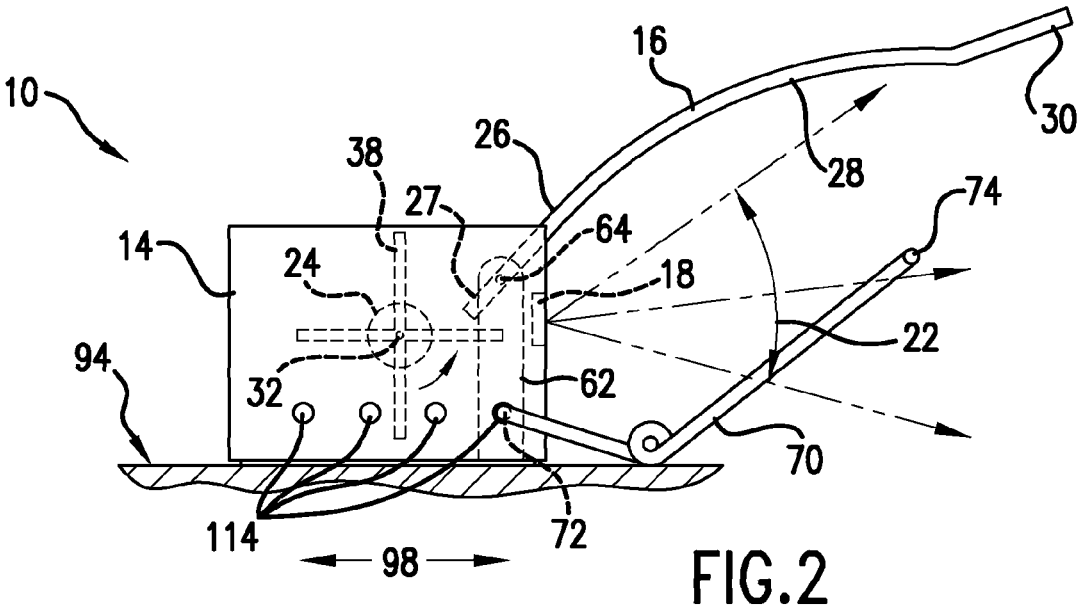
FIG. 2 is a side view of the closing mechanism of FIG. 1.

One exemplary embodiment of the closing mechanism 10 is illustrated with reference to FIGS. 1 and 2. The closing mechanism 10 includes a frame 14 that can be made out of any suitable material such as plastic, metal or wood. The frame 14 may be generally rectangular in shape, although various shapes are possible. The closing mechanism 10 may include a sensor 18 located at a front wall of the frame 14 that has a lens, emitter, or other member oriented out of the interior of the frame 14. The sensor 18 may be carried by the frame 14 and can be completely or partially within the interior of the frame 14, or may be completely outside of the interior of the frame 14. The closing mechanism 10 can include a central processing unit 34 that may be a logic circuit in some embodiments. The central processing unit 34 may include memory that can be dynamic or solid state. The central processing unit 34 may be capable of obtaining a signal from the sensor 18 that is used to determine whether a user 20 has left the vicinity of the toilet 12. In this regard, the central processing unit 34 is in communication with the sensor 18. The communication may be one way in that a signal is sent from the sensor 18 to the central processing unit 34 but a signal is not sent from the central processing unit 34 to the sensor 18. In other arrangements, the communication may be two way in that signals are sent back and forth between the central processing unit 34 and the sensor 18. It is to be understood that as used herein, the term communication is broad enough to include both one way communication and two way communication.

The central processing unit 34 may also be capable of determining if one or more pivoting members 40 of the toilet 12 are in the open position 44 so that the central processing unit 34 can determine whether the closing mechanism 10 must act to close the pivoting member or members 40. The central processing unit 34 may be in communication with a motor 24 so that signals sent from the central processing unit 34 to the motor 24 function to turn on the motor 24 to actuate the motor 24. Again, signal communication between the central processing unit 34 and the motor 24 may be one way in that signals are only sent from the central processing unit 34 to the motor 24, or may be two way so that signals are sent both back and forth to and from the central processing unit 34 and the motor 24. In this regard, if the signal communication is two way, the motor 24 can send a signal back to the central processing unit 34 to inform the central processing unit 34 of a rotational or actuation state of the motor 24. This signal may be used to interpret the position of a closing member 16 or drive shaft 32 so that the central processing unit 34 can determine whether the pivoting member or members 40 are in an open position 44 or a closed position 46. In alternative arrangements, a sensor (not shown) may be in communication with the central processing unit 34 to inform the central processing unit 34 of whether the pivoting member 40 is open 44 or closed 46. In yet other arrangements, the closing mechanism 10 can be arranged so that knowledge of the position of the pivoting member 40 or drive shaft 32 or any positional state of the motor 24 is not necessary for the central processing unit 34 to know. The closing mechanism 10 can still function to close the pivoting member 40 when left open.

A battery 36 may also be included within the interior of the frame 14 and can be used to power both the central processing unit 34, motor 24, and sensor 18. In other arrangements, additional batteries can be included to power various components of the closing mechanism 10. The motor 24 may be completely contained within the interior of the frame 14 or may have one or more parts that protrude from the interior. Also, the apertures through which the various parts may protrude from the interior to the exterior may be sealed to prevent water from entering the interior of the frame 14 or otherwise damaging components of the closing mechanism 10. The motor 24 can be in communication with a drive shaft 32 that is a part of the motor 24 or is coupled to the motor 24. The motor 24 functions to rotate the drive shaft 32. As used herein, the term "rotation" and the term "pivoting" mean the same thing in that a member is turned in relation to another member. Rotation and pivoting need not be completely 360° rotation about an axis, but may only be partial turning about an axis that can be any degree of turning, for example the amount of rotation may be from 1°-5°, from 6°-10°, from 0°-95°, or up to 270°.

The drive shaft 32 can be in communication with a closing member 16 by way of a paddle wheel 38. Other drive train components such as gears, belts, couplers, and other shafts could be included in other arrangements. The closing member 16 engages the pivoting member 40 and urges the pivoting member 16 to a closed position 46. Rotation of the drive shaft 32 is communicated to the closing member 16 to cause rotation of the closing member 16. The closing member 16 can include a base portion 26 that has an engagement portion 27 that engages the paddle wheel 38. The base portion 26 can be rectangular in shape and may be made out of plastic, metal, wood, or any suitable material. The engagement portion 27 may be that part of the base portion 26 that is on an opposite side of a mounting pin 64 than the other part of the base portion 26 that engages a body 28 of the closing member 16. The engagement portion 27 can be integrally formed with the base portion 26 and thus essentially the same part or could be a separate part that is subsequently attached to the base portion 26.

The closing member 16 is pivotally attached to the frame 14 by way of a pin 64 that is mounted to a pair of mounting blocks 62 on opposite sides of the base portion 26 in the lateral direction 100. The mounting blocks 62 may be rigidly attached to the frame 14 and not move relative to the frame 14. The pin 62 can be attached to the mounting blocks 62 and may pivot relative to the mounting blocks 62. The base portion 26 can be rigidly attached to the pin 64 so that rotation of the base portion 26 causes the pin 64 to rotate relative to the mounting blocks 62. In other arrangements, the pin 64 can be rigidly attached to the mounting blocks 62 and the base portion 26 can rotate about pin 64. The paddle wheel 38 rotates upon rotation of the drive shaft 32 and one or more of its paddles may engage the engagement portion 27 and cause it, and thus the entire closing member 16, to rotate about the pin 64. The paddle wheel 38 rotates counter-clockwise in FIG. 2. In other exemplary embodiments, other mechanisms of causing the closing member 16 to rotate may be employed. For example, the base portion 26 may be rigidly attached to the drive shaft 32 so that rotation of the drive shaft 32 is directly translated into rotation of the base portion 26.

A body 28 of the closing member 16 is rigidly attached to the base portion 26 and extends from the base portion 26. The body 28 may have a curved portion as can be more easily seen with reference to FIG. 2. The curved portion is arranged so that a lower, concave surface of the body 28 faces towards the bowl 96 of the toilet 12. An upper, convex surface of the body 28 faces away from the user 20 that is using the toilet 12 or standing next to the toilet 12. The upper, convex surface of the body 28 may directly face the tank 92 of the toilet 12, while the lower, concave surface of the body 28 may face away from the tank 92 and can directly face the user 20, rim surface 90, and/or pivoting member 40. The curved body 28 allows closing member 16 to be positioned in a closed and open orientation with respect to the toilet 12 and pivoting member 40 so that it does not inadvertently engage other components of the assembly and can be moved in this manner. However, it is to be understood that the body 28 need not be curved in other arrangements of the closing mechanism 10. An attachment portion 30 may be located at the terminal end of the body 28 opposite the terminal end to which the base portion 26 is attached. The attachment portion 30 can be rigidly attached to the pivoting member 40. In other arrangements, the attachment portion 30 is not rigidly attached to the pivoting member 40 but can engage the pivoting member 40 to rotate the pivoting member 40. It is to be understood that the arrangement of the closing member 16 shown and described is only exemplary and that the various components of the closing member can be eliminated, added, or modified from the embodiment described.

The closing mechanism 10 is attached to the toilet 12 such that the frame 14 is rigidly attached to the toilet 12. Any form of attachment may be used to connect the frame 14 to the toilet 12. In one embodiment, an adhesive strip 118 is located at the bottom of the frame 14. The adhesive strip 118 may be supplied with the frame 14 and can be permanently attached. The closing mechanism may come with an alcohol wipe that the user 20 can use to clean a flat surface 94 of the toilet 12. The user 20 can then remove a peel strip of the adhesive strip 118 and apply the frame 14 and adhesive strip 118 to the cleaned flat surface 94 to cause the frame 14 and hence closing mechanism 10 to be rigidly attached to the toilet 12. Other forms of attachment are possible. For example, bolts, clamps, or other mechanical fasteners may be used to rigidly attach the frame 14 to the toilet 12. Further, the frame 14 need not be permanently attached to the toilet 12 but could be releasably attached to the toilet 12 so that it can be removed and reattached when desired. Also, the frame 14 need not even be attached to the toilet 12. In this regard, should the closing member 16 be rigidly attached to the pivoting member 40, the frame 14 may simply engage the toilet 12 and need not itself be attached to the toilet 12.

Figure 3:
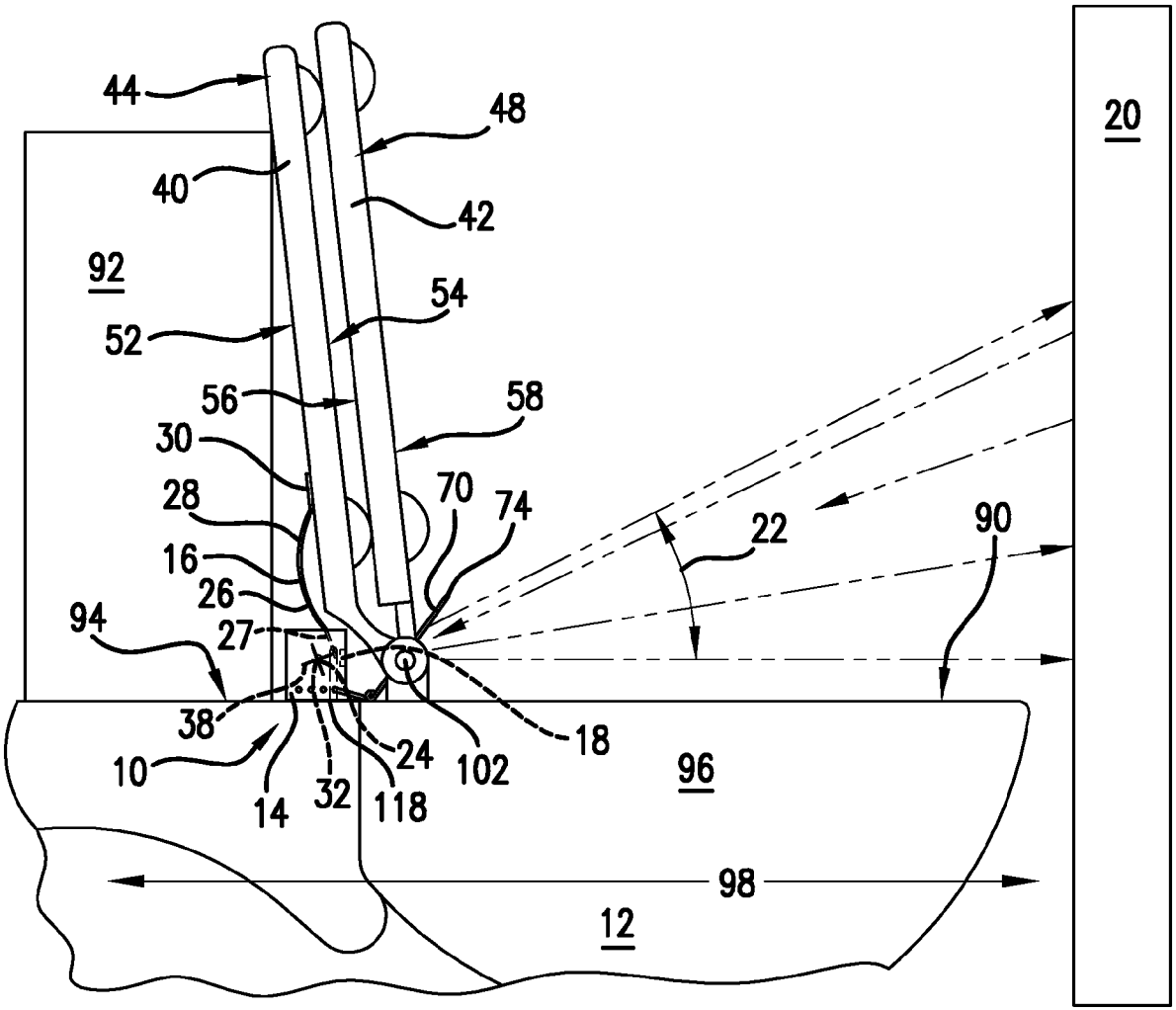
FIG. 3 is a side view of a toilet that includes a closing mechanism in accordance with another exemplary embodiment.

FIG. 3 shows the closing mechanism 10 attached to the toilet 12. The toilet 12 has a first pivoting member 40 that is a lid, and a second pivoting member 42 that is a seat that are both located in an open position. The first pivoting member 40 is in a first pivoting member open position 44 and can rest against a tank 92 of the toilet 12. The second pivoting member 42 is in a second pivoting member open position 48 and can rest against the first pivoting member 40.

The sensor 18 has a field of view 22 and in the embodiment shown in FIG. 3 senses the presence of a user 20. The sensor 18 can be configured in a variety of manners. For example, the sensor 18 may be an active sensor that injects something, such as light, microwaves, or sound, into the environment to determine the presence or absence of the user 20. Beams shown in conjunction with the field of view 22 are shown being emitted from the sensor 18 and then striking the user 20 and bouncing back to the sensor 18 In one embodiment, the sensor 18 may include a portion at the frame 14 and another portion at a wall or other object in front of the toilet 12 that can be a photosensor. A light beam can be transmitted between these two portions. Once a user 20 moves in front of the toilet 12 and breaks the light beam, a signal can be sent to the central processing unit 34. After the user 20 leaves and no longer interrupts the light beam between the two portions of the sensor 18, the sensor 18 will send a signal to the central processing unit 34 that can be used to activate the motor 24.

In another embodiment, the sensor 18 may emit microwave energy that is bounced back to the sensor 18 for detection. When the amount of reflected energy changes, the sensor 18 will know that a user 20 is proximate the toilet 12. Once the user 20 leaves the amount of reflected energy may change back thus instructing the sensor 18 and/or central processing unit 34 that the user 20 is no longer proximate to the toilet 12. The motor 24 could be turned on to ensure the pivoting member 40 is closed. In yet another exemplary embodiment, the sensor 18 may emit ultrasonic sound waves that are reflected back to the sensor 18. When the amount or pattern of reflected ultrasonic sound waves change, the sensor 18 and/or central processing unit 34 may determine that a user 20 has entered or moved from the field of view 22. As such, in various embodiments the sensor 18 may emit a pulse of energy onto an object, for example onto the user 20, and may receive the reflected pulse of energy back from the object. The various energy sent out and received within the field of view 22 may be seen with reference to FIG. 3. Although the field of view 22 is not illustrated in some other embodiments, it is to be understood that this is for sake of clarity and that the field of view 22 and the energy sent out and/or received into the sensor 18 can be present even though not shown in the figures.

The sensor 18 may in other embodiments be a passive sensor 18 instead of an active sensor. A passive sensor does not emit energy into the environment but rather simply observes the environment. One type of passive sensor may be a passive infrared detector or pyroelectric sensor that sees infrared light. The sensor 18 may view the infrared light detected from the field of view 22. When a rapid change in infrared light in the field of view 22 is detected the sensor 18 may send a signal indicating that a user 20 has entered the field of view 22. When another, subsequent rapid change in infrared light in the field of view 22 is detected, the sensor 18 may send a signal to the central processing unit 34 that is used to determine that the user 20 has left the field of view 22. If the sensor 18 then views no change in the field of view 22 in infrared light the sensor 18 may send another signal that verifies that the user 20 has left and this signal can be used to instruct the motor 24 to turn on to rotate the closing member 16. Alternatively, this waiting signal is not used to turn on the closing member 16 but instead the subsequent rapid change in infrared light determination signal is used to actuate the motor 24.

A lens can be included with the sensor 18 to give a large field of view 22. The field of view 22 may extend in the longitudinal direction 98 and can extend in a lateral direction 100. Also, the field of view 22 may extend in the vertical direction so as to be above a rim surface 90 of the toilet 12 and even at a height above the tank 92 of the toilet. The field of view 22 may be partially blocked by various components of the toilet at different times such as the first pivoting member 40, second pivoting member 42, or components of the closing mechanism 10. Although some of the field of view 22 may be blocked, other portions of the field of view 22 may be unblocked thus allowing the sensor 18 to see the user 20 to determine whether the user 20 has left the vicinity of the toilet 12. As such, a completely unobstructed view need not be afforded the sensor 18 for the sensor 18 to accurately determine when a user 20 has left the field of view 22 of the sensor 18 and thus has left the vicinity of the toilet 12. It is to be understood that the variously configured sensors 18 all may have a field of view 22 even though this was not explicitly disclosed as being present in the various embodiments. Also, the sensor 18 could be configured differently from those previously discussed in other exemplary embodiments of the closing mechanism 10.

The closing member 16 is shown in an upwards position in FIG. 3 and the attachment portion 30 is rigidly attached to an upper surface 52 of the first pivoting member 40. The upper surface 52 directly faces the tank 92 when the first pivoting member 40 is in the first pivoting member open position 44. The attachment portion 30 can be attached to the upper surface 52 via adhesives, mechanical fasteners, magnetic connection, or any other form of attachment. The attachment portion 30 may be permanently attached to the upper surface 52 or can be removably attached so that it can be attached and removed at will by the user 20. Although shown as attached to and engaging the upper surface 52, the attachment portion 30 need not be attached to the upper surface 52 in other arrangements but could engage and disengage the upper surface 52. Also, the attachment portion 30 could be attached and engage the lower surface 54 in other arrangements. Further, the attachment portion 30 may engage and be attached to the lower surface 54 in other embodiments. The lower surface 54 of the first pivoting member 40 faces directly away from the tank 92 when the first pivoting member 40 is in the first pivoting member open position 44. As shown in FIG. 3, the second pivoting member 42 is in the second pivoting member open position 48 but does not engage the closing member 16. In accordance with other exemplary embodiments, the attachment portion 30 may be attached to the upper surface 56 of the second pivoting member 42, or to the lower surface 58 of the second pivoting member 42. In still other arrangements, a second closing member 16 (possibly with a second motor 24) could be present and could engage either of the surfaces 56 or 58 while the first closing member 16 engages one of the surfaces 52, 54.

Figure 4:
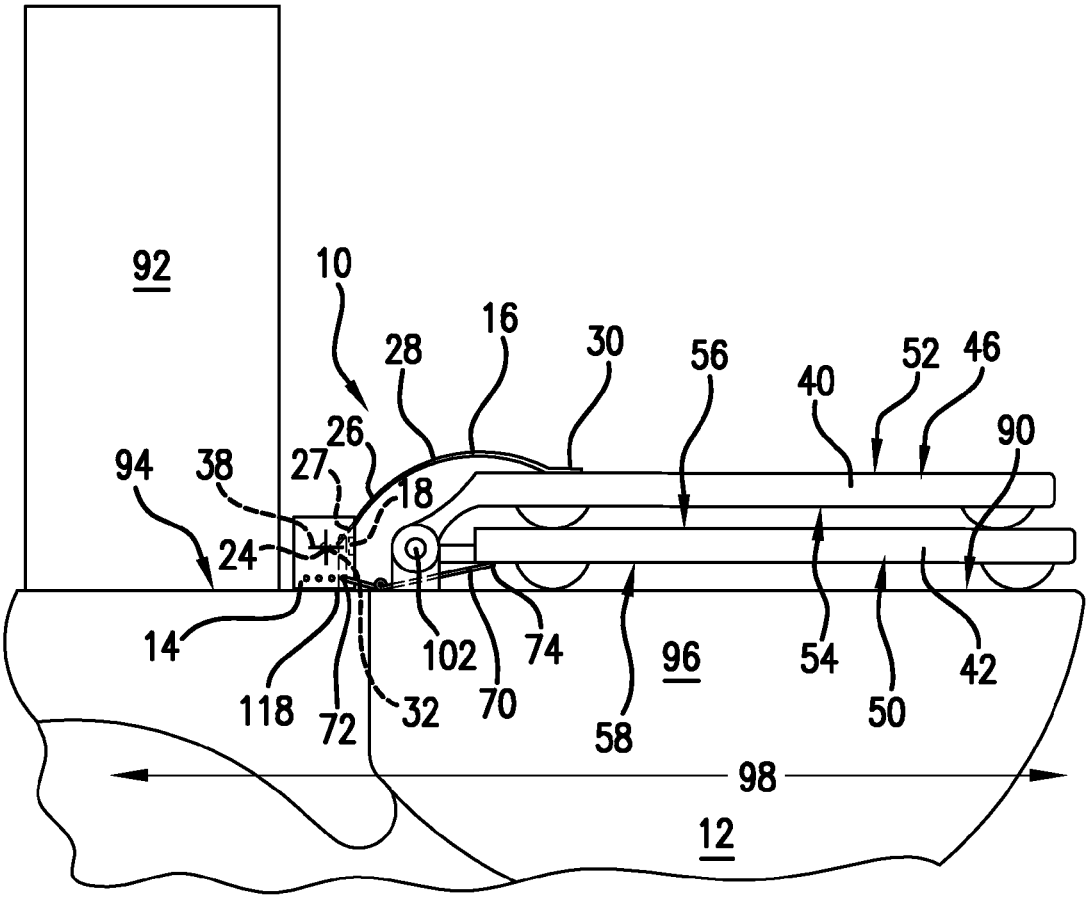
FIG. 4 is a side view of the toilet of FIG. 3 with the pivoting members in closed positions.

The sensor 18 may determine that the user 20 is present and thus the central processing unit 34 may not function to cause the closing mechanism 10 to effect closure. However, once the user 20 leaves the field of view 22 or the sensor 18 otherwise senses the user 20 has left the vicinity of the toilet 12, the closing mechanism 10 may effect closure. FIG. 4 shows the toilet 12 of FIG. 3 in which the pivoting members 40, 42 have been moved to the first pivoting member closed position 46 and the second pivoting member closed position 50. Closure in this exemplary embodiment is effected by rotation of the closing member 16 in the clockwise direction (towards the bowl 96) that urges the attached first pivoting member 40 to likewise move in the clockwise direction (towards the bowl 96). Movement of the first pivoting member 40 clockwise causes the first pivoting member 40 to be urged against the second pivoting member 42 and thus the second pivoting member 42 is urged in the clockwise direction (towards the bowl 96). The closing mechanism 10 may be configured so that it can close the pivoting members 40, 42 but cannot move the pivoting membes 40, 42 back up into the open positions 44, 48. However, in other exemplary embodiments, the closing mechanism 10 can in fact be arranged so that it can move the pivoting members 40, 42 back up into the open positions 44, 48.

Figure 5:
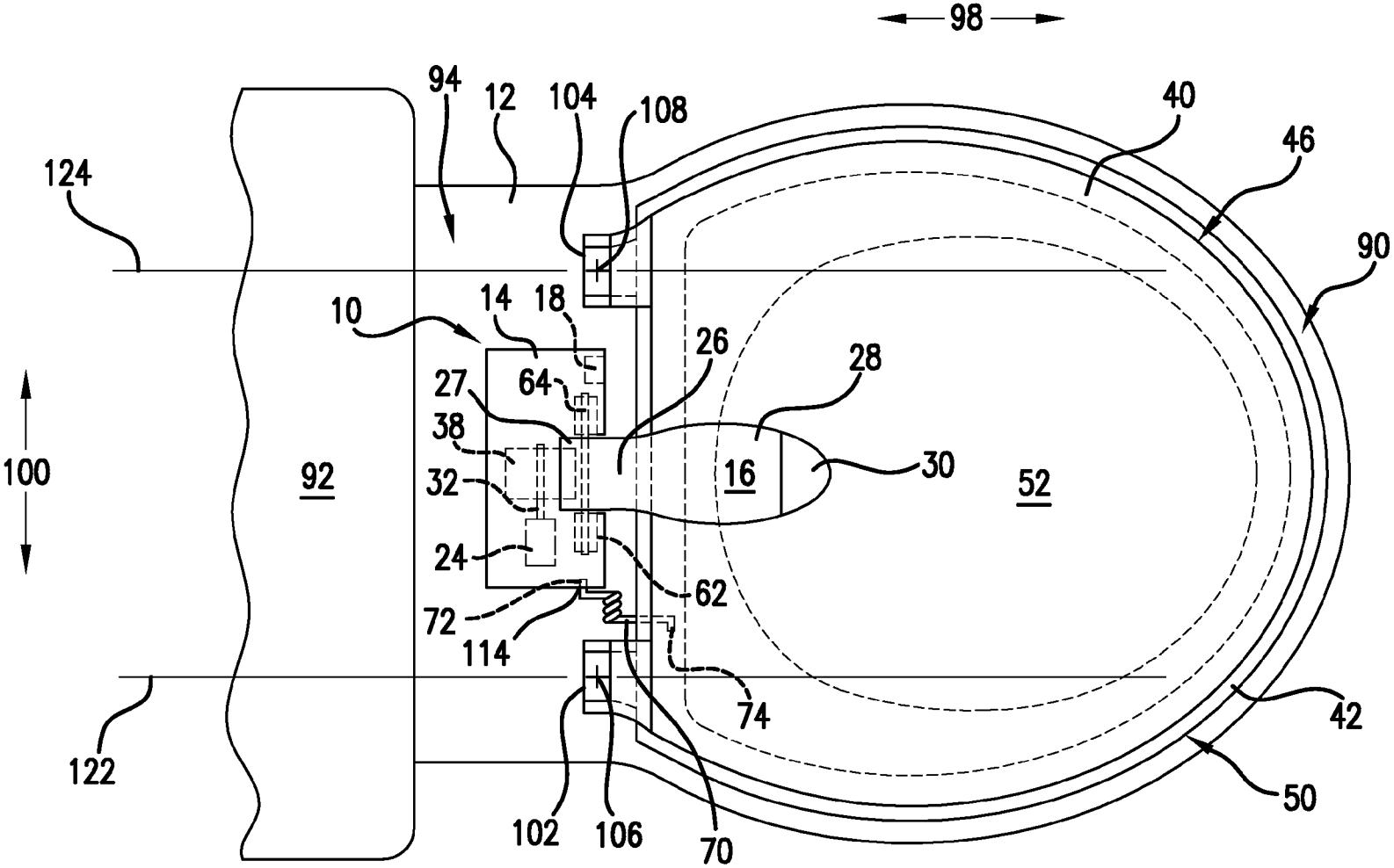
FIG. 5 is a top view of the toilet of FIG. 4.
Figure 6:
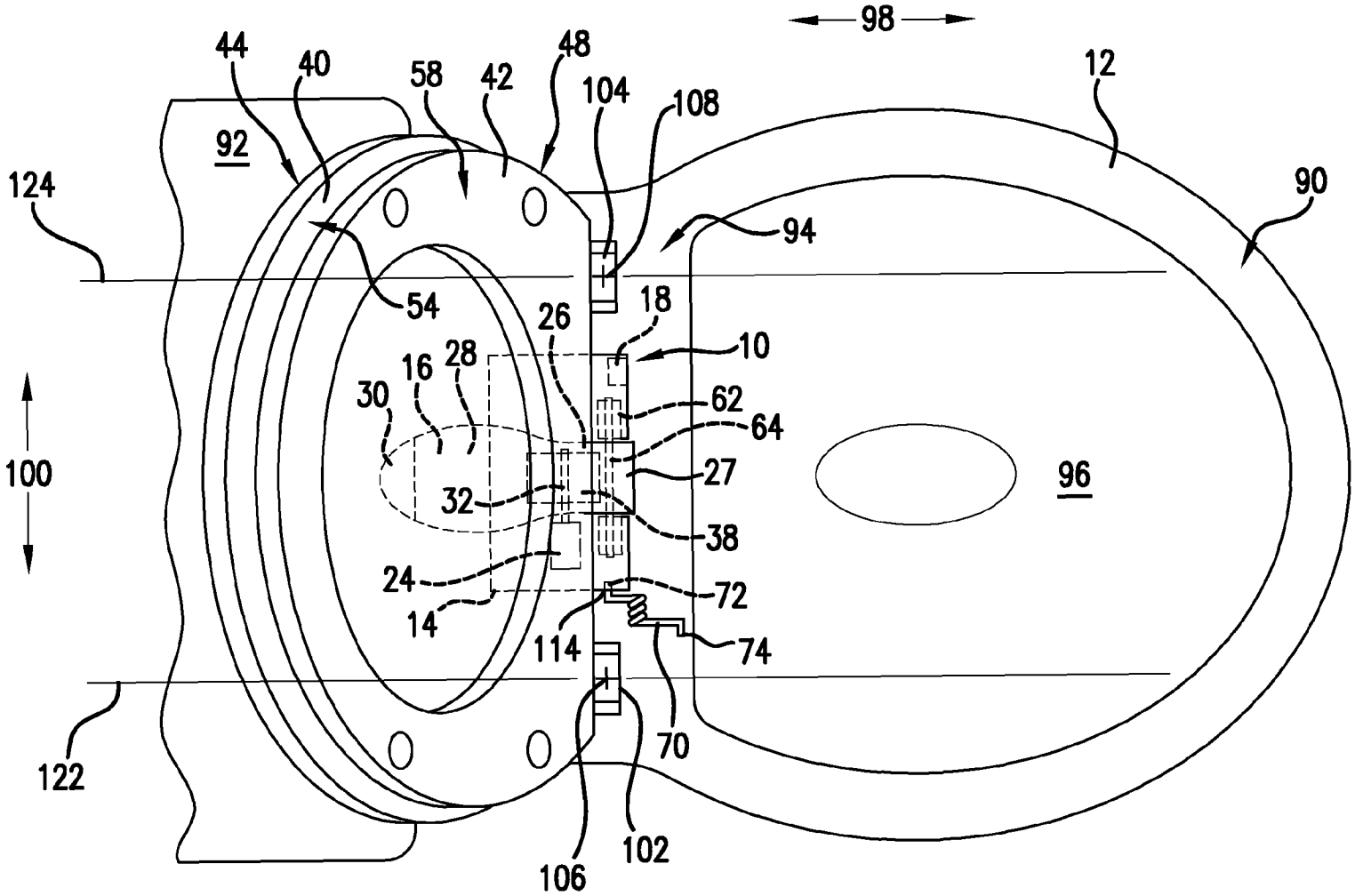
FIG. 6 is a top view of the toilet of FIG. 3.

FIGS. 5 and 6 are top views of the toilet 12 with the pivoting members 40 and 42 in the closed 46, 50 and open 44, 48 positions. The toilet 12 has a bowl 96 that is located forward of a tank 92 of the toilet 12 in the longitudinal direction 98. A rim surface 90 of the bowl 96 is visible in FIG. 6 and is located forward of a flat surface 94 of the toilet 12 in the longitudinal direction 98. The flat surface 94 is located between the rim surface 90 and the tank 92 in the longitudinal direction 98. Hinges 102 and 104 are used to attach the pivoting members 40 and 42 to the toilet 12. Hinge 102 is placed at a location of attachment 106 at the flat surface 94, and hinge 104 is placed at a location of attachment 108 at the flat surface 94. Bolts can be used to effect attachment of the hinges 102 and 104 to the flat surface 94. A bolt may extend through the location of attachment 106 and a second bolt may extend through the location of attachment 108.

A boundary line 122 is defined through the location of attachment 106, and a boundary line 124 is defined through location of attachment 108. The boundary lines 122 and 124 are spaced from one another in the lateral direction 100. The boundary lines 122 and 124 may thus extend through the hinges 102, 104 and through the bolts that connect the hinges 102, 104 to the toilet 12. The closing mechanism 10 may be arranged with respect to the toilet 12 so that it is entirely located between the boundary lines 122 and 124 in the lateral direction 100. As shown in FIGS. 5 and 6, the frame 14, motor 24, drive shaft 32, closing member 16, sensor 18, dampening member 70 (and dampening member 76 if present) and other portions of the closing mechanism 10 may be located completely between the boundary lines 122 and 124 so that no portion of these members extends beyond either of the boundary lines 122 and 124 in the lateral direction 100. The components that are between the boundary lines 122 and 124 in other embodiments in the lateral direction 100 may be any or all of the components at the adhesive strip 118 or higher as shown in FIGS. 1, 2 and/or 7. This arrangement may prevent inadvertent damage to these members of the closing mechanism 10, may make it easier to clean these members of the closing mechanism 10, provide better functioning of the closing mechanism 10, and may provide a more aesthetically appealing closing mechanism 10. Also in the embodiment shown, none of these components of the closing mechanism 10 are even located in the lateral direction 100 at either one of the hinges 102, 104 such that all of the components are located completely between even the interior edges of the hinges 102 and 104 in the lateral direction 100. However, in accordance with other exemplary embodiments, one or more of these components of the closing mechanism 10 may in fact be located beyond one or both of the boundary lines 122 and 124 so that all of these components of the closing mechanism 10 are not completely located between the boundary lines 122 and 124 in the lateral direction 100. In some arrangements, when the closing mechanism 10 is understood to include the toilet 12, all of the components of the closing mechanism 10 may be between the boundary lines 122 and 124 except for the toilet 12 and pivoting members 40 and 42.

As used herein, when described as being between in the lateral direction 100, it is to be understood that the location in the longitudinal direction 98 is irrelevant. As such, an object/component may still be completely between the boundary lines 122 and 124 in the lateral direction 100 even if the object/component is three feet in front of the bowl 96 in the longitudinal direction 98.

The closing mechanism 10 may be arranged so that it is attached to the flat surface 92 and is located between the tank 92 and the cavity of the bowl 96 visible at the rim surface 90 in the longitudinal direction 98. The closing member 16 has a body 28 that may be curved as previously discussed, but may also widen in the lateral direction 100 upon extension away from the base portion 26 as shown with reference to FIG. 5. However, the body 28 may maintain the same width in the lateral direction 100 upon extension away from the base portion 26 in the longitudinal direction 98 in other embodiments.

With reference back to FIGS. 1 and 2, the closing mechanism 10 may include a dampening member 70 in some arrangements. The dampening member 70 can be used to slow the rotational speed of the pivoting member 40 so that the pivoting member 40 does not slam into the rim surface 90, second pivoting member 42, or other object upon being moved from the open position 44 to the closed position 46. The dampening member 70 may thus absorb some of the momentum of the falling/closing pivoting member 40 and absorb this energy so that the pivoting member 40 closes with less force and does not slam or bang into other components. However, it is to be understood that the dampening member 70 need not be present in other arrangements. The pivoting member 40 may have sufficient frictional resistance upon configuration of the hinge 102, 104 attachments so that it does not slam into the rim surface 90 or other components. Also, the closing mechanism 10 may be set up so that slamming of the pivoting member 40 in fact occurs. Cushions may be located on the lower surfaces 54 and/or 58 of the pivoting members 40 and 42 as shown for example in FIGS. 3 and 4 to absorb energy of closing pivoting members 40 and 42 to prevent this unwanted noise/damage. In yet other arrangements, the closing member 16 itself may be strong enough to slowly rotate the pivoting member 40 so that the pivoting member 40 does not fall via gravity but is instead completely rotated and held via the closing member 16. The motor 24 may be sufficient to both rotate and hold the pivoting member 40 through its entire length of travel from the open position 44 to the closed position 46.

The dampening member 70 if present may be a spring, pneumatic cylinder, cushion, or other object capable of slowing the rotation speed of the pivoting member 40. With reference back to FIGS. 1 and 2, the dampening member 70 is a spring that has a first end 72 and an oppositely disposed second end 74. The spring is arranged so that a linear portion extends from a coil and turns at a 90° angle to form the first end 72 that is at a terminal end of the dampening member 70. A second linear portion extends from the coil in a different direction in the longitudinal direction 98, and a portion then turns from this linear portion at a 90° angle to form the second end 74. The first end 72 is inserted into one of a plurality of apertures 114 that are disposed through the frame 14. The apertures 114 are spaced from one another in the longitudinal direction 98. The apertures 114 allow the position of the dampening member 70 to be adjusted with respect to the frame 14 and hence with respect to portions of the toilet 12 when the frame 14 is attached to the toilet 12. This adjustment allows for the dampening member 70 to contact the pivoting member 40 or pivoting member 42 to account for different toilets 12 that may have differently sized, shaped or configured pivoting members 40, 42. As such, the apertures 114 allow for adjustment so that the dampening member 70 properly engages the pivoting member 40 or 42. Although shown as extending completely through a wall of the frame 14 to the interior of the frame 14, in other embodiments the apertures 114 may not extend completely through the wall into the interior.

The first end 72 can be rigidly attached to the frame 14 so that these components cannot be disengaged without one having to firmly pull the first end 72 from the aperture 114. The portion of the dampening member 70 extending from the first end 72 to the coil may engage the flat surface 94, although it is shown as being spaced upwards from the flat surface 94 in the vertical direction in FIG. 2. The coil may engage the flat surface 92, and the second end 74 and a portion of the dampening member 70 extending from the coil to the second end 74 may be oriented upwards at some angle in the vertical direction. The dampening member 70 is shown in its unbiased, at rest position in FIGS. 1 and 2.

FIG. 3 shows the dampening member 70 in the unbiased, at rest state in which the second end 74 is shown located generally between the pivoting members 40, 42 and the rim surface 90. Actuation of the motor 24 causes the closing member 16 to rotate to cause the pivoting members 40 and 42 to likewise rotate. The pivoting member 42 will rotate until such time that the lower surface 58 of the pivoting member 42 engages the second end 74 of the dampening member 70. The momentum of the falling pivoting member 42 will be transferred into the dampening member 70, and the speed of rotation of the pivoting member 42 will decrease upon contact with the dampening member 70. As used herein, the term decreasing the speed of rotation means that the pivoting member 40 and/or 42 will have its rotational speed decreased, or will have it remain the same or not increase, or will increase it some amount. The dampening member 70 thus changes the speed of rotation of the pivoting member 40 and/or 42 due to its presence such that the speed is different than what would be the case if the dampening member 70 were not present. In some arrangements, the speed of the pivoting member 40 and/or 42 will increase upon contact with the dampening member 70, but the presence of the dampening member 70 will function to minimize the increase in acceleration the pivoting member 40 and/or 42 would have experienced if the dampening member 70 were not present. As such, when the dampening member 70 is stated as decreasing the speed, it is to be understood that this may simply mean that the speed is different than what otherwise would have been experienced if the dampening member 70 were not present and this difference is some amount less than that which would have been experienced.

The arrangement of the dampening member 70 in FIG. 4 is such that it engages the second pivoting member 42 but not the first pivoting member 40. Here, the first pivoting member 40 does not contact the dampening member 70. However, since the second pivoting member 42 may have its speed decreased, it is the case that the first pivoting member 40 may likewise experience a decrease in speed since its momentum may be transferred into the second pivoting member 42 and hence absorbed and slowed down by the dampening member 70.

Figure 7:
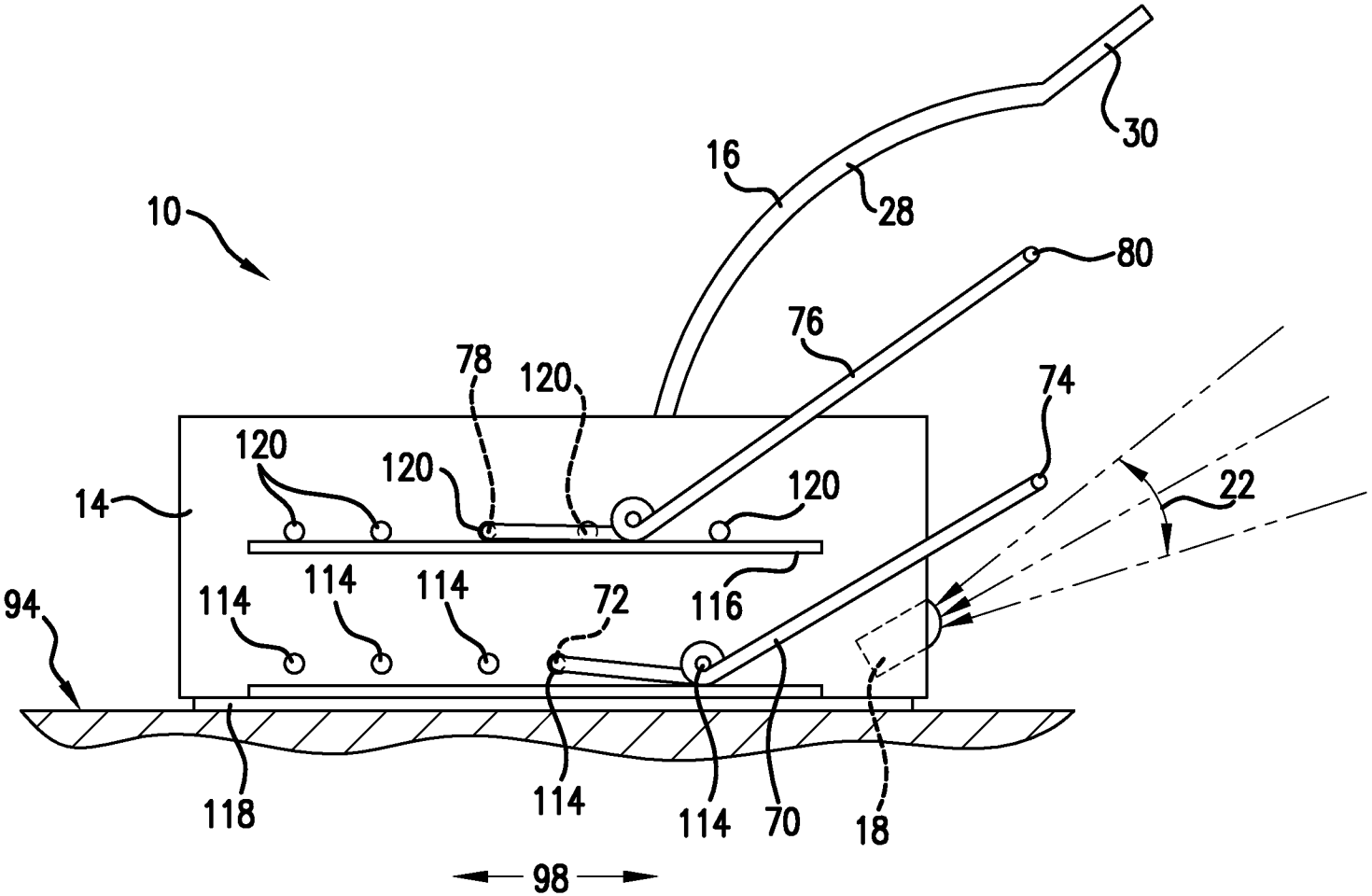
FIG. 7 is a side view of a closing mechanism in accordance with another exemplary embodiment.

An alternative exemplary embodiment of the closing member 16 is shown with reference to FIG. 7. The sensor 18 is angled a bit differently than that in the previous embodiment, but can be otherwise configured in a similar manner. The closing mechanism 16 includes a second dampening member 76. The second dampening member 76 may include a first end 78 that engages the frame 14 and a second end 80 that is at an opposite terminal end that is oriented vertically higher than the rest of the second dampening member 76. The second dampening member 76 may be arranged in similar manner to the first dampening member 70 and a repeat of this information is not necessary. The frame 14 may include a second plurality of apertures 120 that may be arranged in a similar manner as the first plurality of apertures 114 only vertically higher.

The apertures 120 can be spaced from one another in the longitudinal direction 98 and the first end 78 can be received within one of the apertures 120. The apertures 120 allow the second dampening member 76 to be positioned relative to the frame 14 so that it is properly positioned for engagement with the first pivoting member 40 and/or the second pivoting member 42. A platform 116 extends in the lateral direction 100 from the wall of the frame 14 so that a portion of the second dampening member 76 such as the first end 78, coil, or other portion can engage the platform 116. The second dampening member 76 may be braced against the platform 116 on one end and can engage one of the pivoting members 40 or 42 on the other end. The first end 78 may be frictionally retained within one of the apertures 120 or may be otherwise attached to the frame 14 in manners previously discussed with respect to the first end 72 and aperture 114.

Figure 8:
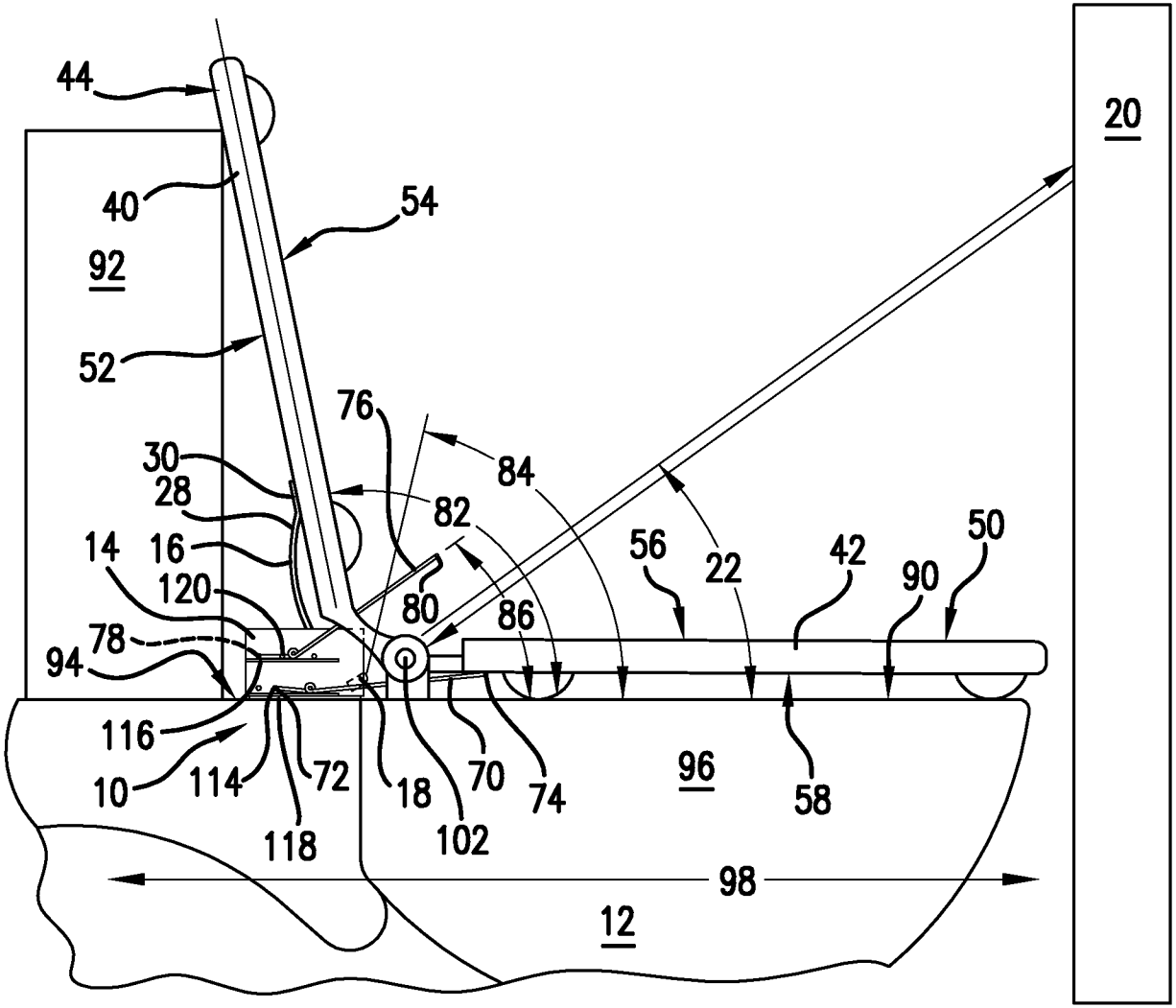
FIG. 8 is a side view of the closing mechanism of FIG. 7 attached to a toilet.
Figure 9:
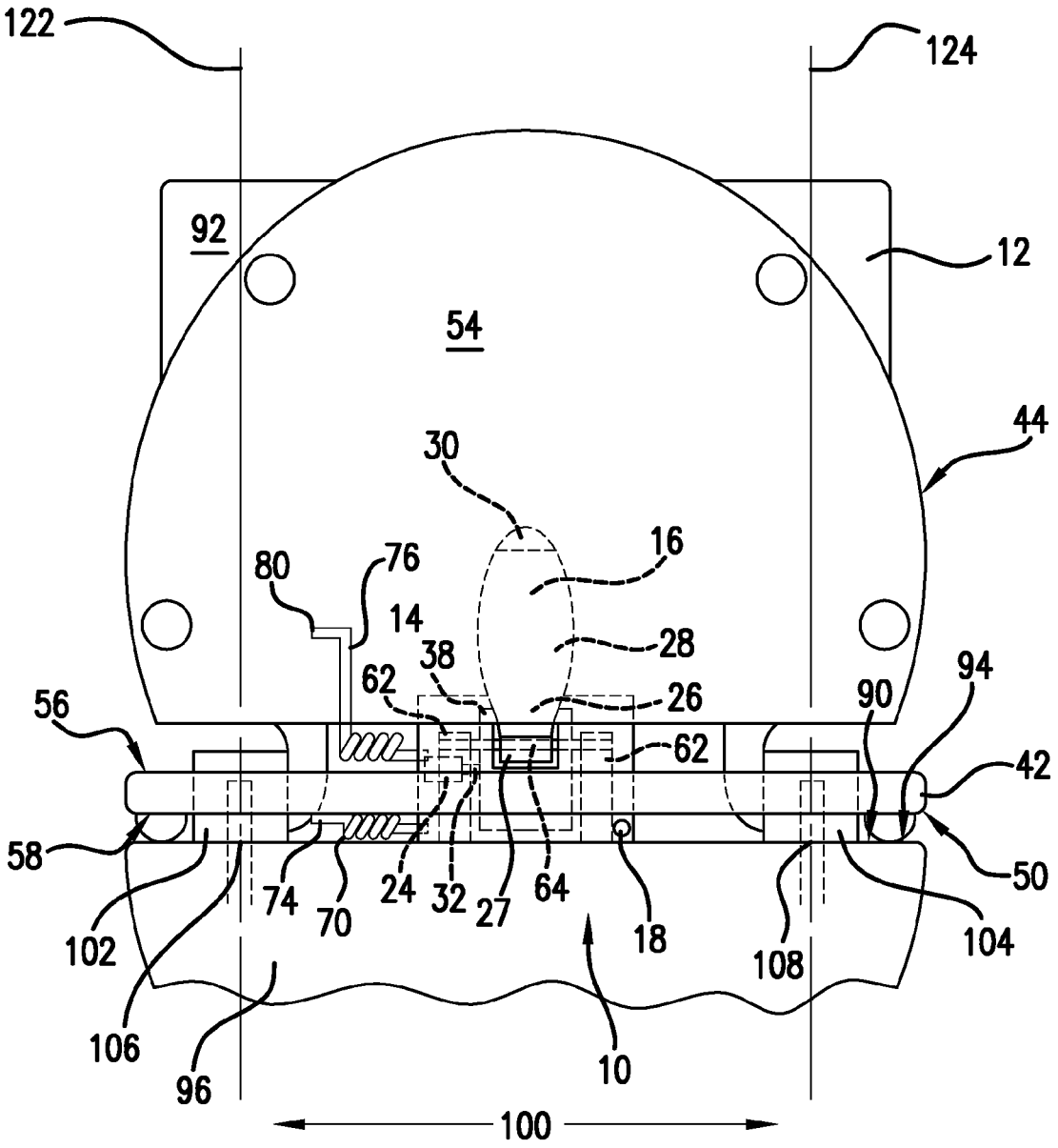
FIG. 9 is a side view of the toilet of FIG. 8.

FIGS. 8 and 9 show the closing mechanism 10 engaged to the flat surface 94. The user 20 is present and the sensor 18 can detect the presence of the user 20. The second pivoting member 42 is a seat that is in the second pivoting member closed position 50 such that the first dampening member 70 engages the lower surface 58. The weight of the second pivoting member 42 is sufficient to compress the first dampening member 70 to a biased position and the first dampening member 70 is not strong enough to push the second pivoting member 42 up from the closed position 50. The second pivoting member 42 can be moved upwards and downward to and from the open and closed positions 48 and 50 and not engage the second dampening member 76 due to the configurations of these components.

A series of positions 82, 84 and 86 are noted in FIG. 8. The positions 82, 84, and 86 are noted relative to the position of the rim surface 90. Position 82 is the orientation of the first pivoting member 40 relative to the rim surface 90 when in the first pivoting member open position 44. This angle may be 95° in some embodiments. The first pivoting member 40 is shown contacting the tank 92 and thus will remain in this position absent force applied thereto through the closing mechanism 10 or by the user 20. The motor 24 may actuate and the closing member 16 can rotate the first pivoting member 40 in the clockwise direction towards the rim surface 90. Once the first pivoting member 40 reaches a certain point, the motor 24 may stop actuating and the closing member 16 may stop urging the first pivoting member 40. At this point, the closing mechanism 10 is turned completely off. However, the first pivoting member 40 may have been rotated to an orientation in which its weight is forward of its pivot point about hinge 102/104. The first pivoting member 40 may move forward due to gravity such that it will continue to rotate clockwise or forward towards the rim surface 90. If frictional resistance of the hinge 102/104 is sufficient, this may cause the first pivoting member 40 to stop rotating. In such instances, the closing member 16 may continue to push to urge the first pivoting member 40 downwards into the closed position 46.

The point at which the closing mechanism 10 may stop urging the first pivoting member 40 in the clockwise direction or towards the rim surface 90 may be designated by position 84. Position 84 may be oriented at a minimum 85° to the rim surface 90 in certain exemplary embodiments. As such, the closing member 16 may urge the first pivoting member 40 from 95° to 85° relative to the rim surface 90 in some embodiments. Position 86 is the location of the second end 80 of the second dampening member 76 with respect to the rim surface 90. Position 86 may be oriented at 30° to the rim surface 90 in some exemplary embodiments. Once the first pivoting member 40 reaches position 84, the closing mechanism 10 no longer urges the first pivoting member 40 and the first pivoting member 40 rotates via gravity. The first pivoting member 40 will essentially freely rotate from position 84 to position 86 such that nothing acts to speed, slow, or urge the first pivoting member 40. Once the first pivoting member 40 reaches position 86 the lower surface 54 will engage the second end 80 and the second dampening member 76 will function to slow down the rotational speed of the first pivoting member 40.

The first pivoting member 40 will continue to rotate due to its momentum from freely rotating and will continue to be dampened by the second dampening member 76. The first pivoting member 40 will engage the second pivoting member 42 at such time the second dampening member 76 will be completely biased. The second dampening member 76 does not have strength adequate to push back the weight of the first pivoting member 40 to rotate the first pivoting member 40 backwards in the counter-clockwise direction. The second pivoting member 42 and first dampening member 70 may be arranged in a manner similar to that of the first pivoting member 40 and second dampening member 76 relative to positions 82, 84, and 86 and a repeat of this information is not necessary. In other arrangements of the closing mechanism 10, a dampening member 70 may engage the first pivoting member 40 that is a lid, but no dampening member engages the second pivoting member 42 that is a seat. In these arrangements, the lid is dampened but falling of the seat is not dampened.

The closing mechanism 10 may function to close one or both of the pivoting members 40, 42 completely independently of flushing of the toilet 12. The closing may be performed only upon sensing when the user 20 has left the toilet 12 and is no longer in proximity of the toilet 12. The closing may be effected once this sensing is accomplished and a timing mechanism is not employed such that the closing is not a timed closing but rather is one that takes place immediately upon sensing the user's 20 absence. The closing mechanism 10 may thus function to close the pivoting members 40, 42 based solely upon sensing the absence of a user 20 and hence be completely independent of toilet 12 flushing or timing. This arrangement may eliminate contamination that would otherwise occur if the user 20 leaves the vicinity of the toilet 12 and some amount of time elapses before closure, and affords the user 20 the opportunity of manually closing the seat/lid after flushing but before leaving the vicinity of the toilet 12 in the instances that flushing occurs when sitting on the seat in the down position or of placing items into the toilet 12 after flushing but before leaving the vicinity of the toilet 12.

All of the components of the closing mechanism 10 may be located completely exterior of the tank 92 such that none of the components of the closing mechanism 10 are located within tank 92. Further, the closing mechanism 10 may be constructed so that none of the components of the closing mechanism 10 engage the handle of the toilet 12 that is used to flush the toilet 12.

The closing mechanism 10 may be arranged so that it is capable of closing the pivoting members 40 and 42 (lid and seat) but not opening the pivoting members 40 and 42. In this regard, the motor 24 may be arranged to rotate only in one direction, for example counter clockwise, and not in two different directions. Likewise, the closing member 16 can be moved in one direction by the motorized components of the closing mechanism 10 but not in the other direction, although it may be moved by a user in the other direction. Opening of the pivoting members 40 and 42 may be effected entirely by the user and cannot be opened by the closing mechanism 10 in certain exemplary embodiments.

The frame 14, sensor 18, motor 24, may remain stationary with respect to the rim surface 90 and flat surface 94 so that they do not move relative to surfaces 90 and 94 in the height direction. The frame 14, sensor 18, and motor 24 may be separate from the pivoting members 40 and 42 so that they are not part of the pivoting members 40 and 42 and are not carried by the pivoting members 40 and 42.

It is to be understood that when the pivoting members 40, 42 are described as being either open or closed, these orientations need not be a single or definite angle with respect to the rim surface 90. The open positions 44, 48 need only be positions associated with the opening of the toilet 12 and need not be a particular orientation but can be variously oriented in different exemplary embodiments. Further, the closed positions 46, 50 need not always be located at a 0° angle to the rim surface 90 but can be any position associated with a closed toilet 12. As such, the open positions 44, 48 are oriented differently than the closed positions 46, 50 but need not be a specific single orientation in all exemplary embodiments. The closing mechanism 10 can be arranged so that it functions to close the pivoting members 40 and/or 42 to the closed positions 46 and/or 50 but cannot function to open the members 40 and/or 42 to the open positions 44 and/or 48. However, in other embodiments, the closing mechanism 10 instead of only being capable of closing can additionally be capable of opening the members 40 and/or 42.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A closing mechanism for a toilet, comprising:

a frame attached to the toilet;

a closing member carried by the frame and attached to a pivoting member of the toilet, wherein the pivoting member is a lid;

a sensor carried by the frame, wherein the sensor is capable of sensing when a user of the toilet leaves a field of view of the sensor;

wherein when the user of the toilet leaves the field of view of the sensor the sensor sends a signal that causes the closing member to rotate the pivoting member from an open position to a closed position, wherein the toilet has a second pivoting member that is a seat, and wherein the closing member is free from engagement with the second pivoting member;

wherein the closing member rotates the lid from the open position to the closed position and in so doing the lid engages the seat and pushes the seat to rotate the seat from a second pivoting member open position to a second pivoting member closed position;

wherein the closing mechanism is incapable of automatically rotating the lid to move the lid from the closed position of the lid back to the open position of the lid; and a motor that is in communication with the closing member, wherein when the signal is sent from the sensor the motor actuates to cause rotation of the closing member, wherein the closing member has a base portion and a body extending from the base portion, wherein the body has a curved shape, and wherein the closing member has an attachment portion at a terminal end of the body that is attached to the pivoting member.

2. The closing mechanism as set forth in claim 1, wherein the closing member engages an upper surface of the lid.

3. The closing mechanism as set forth in claim 1, further comprising a dampening member carried by the frame, wherein the dampening member decreases the speed of rotation of the pivoting member before the pivoting member reaches the closed position.

4. The closing mechanism as set forth in claim 1, wherein the toilet has a rim surface, a tank, and a flat surface located between the tank and the rim surface, wherein the frame is attached to the flat surface.

5. A closing mechanism for a toilet, comprising:

a toilet that has a bowl that has a rim surface, wherein the toilet has a tank, wherein the tank is spaced from the bowl in a longitudinal direction of the toilet, wherein the toilet has a flat surface located between the tank and the rim surface in the longitudinal direction, wherein the toilet has a pivoting member that is attached to the flat surface by a pair of hinges that are attached to the flat surface, wherein locations of attachment of the pair of hinges to the flat surface are spaced from one another in a lateral direction of the toilet;

a frame that is attached to the flat surface;

a closing member carried by the frame; and a sensor that sends a signal that causes the closing member to move so that the closing member in turn causes the pivoting member to move to a closed position;

wherein the frame, the closing member, and the sensor are all located completely between the locations of attachment of the pair of hinges to the flat surface in the lateral direction of the toilet, and wherein the closing member is capable of causing the pivoting member to move to the closed position but is not capable of causing the pivoting member to move to an open position, wherein the frame and the closing member do not engage the pair of hinges and wherein the frame and the closing member are both spaced from the pair of hinges in the lateral direction of the toilet such that the frame and the closing member are located completely inboard of the pair of hinges in the lateral direction such that no portion of the frame and the closing member are located outboard of the pair of hinges in the lateral direction.

6. The closing mechanism as set forth in claim 5, wherein the sensor is carried by the frame, wherein the sensor is capable of sensing when a user of the toilet leaves a field of view of the sensor, wherein the sensor is a passive sensor.

7. The closing mechanism as set forth in claim 6, wherein the sensor is an infrared sensor that detects infrared light.

8. The closing mechanism as set forth in claim 5, wherein the sensor is at least partially carried by the frame, wherein the sensor is capable of sensing when a user of the toilet leaves a field of view of the sensor, wherein the sensor is an active sensor.

9. The closing mechanism as set forth in claim 8, wherein the sensor emits light, microwaves, or ultrasonic sound for use in sensing when the user leaves the field of view of the sensor.

10. The closing mechanism as set forth in claim 5, wherein the frame extends in the longitudinal direction beyond the locations of attachment of the pair of hinges to the flat surface such that the tank is closer to the frame in the longitudinal direction than the tank is to the locations of attachment of the pair of hinges to the flat surface in the longitudinal direction.

11. The closing mechanism as set forth in claim 5, further comprising:

a motor carried by the frame;

a central processing unit carried by the frame, wherein the central processing unit is a logic circuit;

a battery that provides power to the motor and the central processing unit, wherein the battery is carried by the frame;

a drive shaft in communication with the motor such that actuation of the motor causes rotation of the drive shaft a paddle wheel that is rigidly attached to the drive shaft such that rotation of the drive shaft causes rotation of the paddle wheel, wherein the paddle wheel engages the closing member to cause rotation of the closing member;

wherein the central processing unit is in communication with the sensor such that the signal from the sensor is received by the central processing unit that in turn causes the central processing unit to send a turn on signal to the motor to cause the motor to actuate.

12. The closing mechanism as set forth in claim 5, further comprising a dampening member carried by the frame, wherein the dampening member decreases the speed of rotation of the pivoting member before the pivoting member reaches the closed position.

13. The closing mechanism as set forth in claim 12, wherein the frame has a plurality of apertures spaced from one another in the longitudinal direction, wherein the dampening member is a spring that has a first terminal end that can be receiving within one of the apertures so that the spring is properly located for decreasing the speed of rotation of the pivoting member before the pivoting member reaches the closed position.

14. The closing mechanism as set forth in claim 12, wherein the pivoting member is a seat that engages the dampening member, wherein the toilet has a second pivoting member is a lid that is attached to the flat surface by the pair of hinges that are attached to the flat surface, wherein the second pivoting member is moveable from a second pivoting member open position to a second pivoting member closed position, and further comprising:

a second dampening member that is carried by the frame, wherein the second dampening member decreases the speed of rotation of the second pivoting member before the second pivoting member reaches the second pivoting member closed position, wherein the second dampening member engages the second pivoting member.

15. A closing mechanism for a toilet, comprising:

a frame attached to the toilet, wherein the toilet has a bowl that has a rim surface, wherein the toilet has a tank that is spaced from the bowl in a longitudinal direction of the toilet;

a closing member carried by the frame and attached to a pivoting member of the toilet, wherein the pivoting member is capable of being rotated from an open position that is oriented at least 90° from the rim surface to a closed position that is oriented 0° to the rim surface, wherein the closing member rotates the pivoting member from the open position to a position that is oriented at least 85° to the rim surface;

a dampening member that decreases the speed of rotation of the pivoting member once the pivoting member is at most oriented 30° to the rim surface, wherein the pivoting member is not acted on by the closing member and is not acted on by the dampening member when the pivoting member is oriented in the range of greater than 30° to less than 85° to the rim surface;

a motor that is actuated to cause movement of the closing member;

a central processing unit that sends a signal to cause the motor to actuate, wherein the central processing unit sends the signal completely independently of a timing mechanism;

wherein the pivoting member is attached to the toilet by a pair of hinges that are spaced from one another in a lateral direction of the toilet, wherein the lateral direction of the toilet is perpendicular to the longitudinal direction of the toilet;

wherein the frame and the closing member do not engage the pair of hinges of the pivoting member, and wherein the frame and the closing member are both spaced from the pair of hinges in the lateral direction of the toilet such that the frame and the closing member are located completely inboard of the pair of hinges in the lateral direction such that no portion of the frame and the closing member are located outboard of the pair of hinges in the lateral direction.

16. The closing mechanism as set forth in claim 15, wherein the dampening member is a spring, and further comprising a sensor capable of sensing when a user of the toilet leaves a field of view of the sensor;

wherein when the user of the toilet leaves the field of view of the sensor the sensor sends a signal to the central processing unit that in turn causes the closing member to rotate the pivoting member from the open position to the position that is oriented at least 85° to the rim surface.

17. A closing mechanism for a toilet, comprising:

a frame attached to the toilet;

a closing member carried by the frame and attached to a pivoting member of the toilet, wherein the pivoting member is a lid;

a sensor carried by the frame, wherein the sensor is capable of sensing when a user of the toilet leaves a field of view of the sensor;

wherein when the user of the toilet leaves the field of view of the sensor the sensor sends a signal that causes the closing member to rotate the pivoting member from an open position to a closed position, wherein the toilet has a second pivoting member that is a seat, and wherein the closing member is free from engagement with the second pivoting member;

wherein the closing member rotates the lid from the open position to the closed position and in so doing the lid engages the seat and pushes the seat to rotate the seat from a second pivoting member open position to a second pivoting member closed position;

wherein the closing mechanism is incapable of automatically rotating the lid to move the lid from the closed position of the lid back to the open position of the lid;

a motor carried by the frame, wherein the motor is located inside of the frame;

a drive shaft in communication with the motor such that actuation of the motor causes rotation of the drive shaft;

a paddle wheel rigidly attached to the drive shaft such that rotation of the drive shaft causes rotation of the paddle wheel, wherein the paddle wheel engages an engagement portion of a base portion of the closing member to cause rotation of the closing member;

a central processing unit carried by the frame, wherein the central processing unit is located inside of the frame, wherein the central processing unit is in communication with the sensor such that the signal from the sensor is received by the central processing unit that in turn causes the central processing unit to send a turn on signal to the motor to cause the motor to actuate.

* * * * *